US005325094A

United States Patent [19]

Broderick et al.

[11] Patent Number: 5,325,094

[45] Date of Patent: Jun. 28, 1994

[54] ELECTROMAGNETIC ENERGY ABSORBING STRUCTURE

[75] Inventors: John F. Broderick, Andover; Noel J. Tessier, North Attleboro; Michael S. Heafey, Billerica; Michael T. Kocsik, Ashland, all of Mass.

[73] Assignee: Chomerics, Inc., Woburn, Mass.

[21] Appl. No.: 883,545

[22] Filed: May 15, 1992

Related U.S. Application Data

[63] Continuation-in-part of Ser. No. 489,924, Feb. 16, 1990, Pat. No. 5,214,432, which is a continuation-in-part of Ser. No. 177,518, Apr. 11, 1988, Pat. No. 5,223,849, which is a continuation-in-part of Ser. No. 10,448, Feb. 23, 1987, abandoned, which is a continuation-in-part of Ser. No. 934,716, Nov. 25, 1986, abandoned.

[51] Int. Cl.[5] ..... H01Q 17/00

[52] U.S. Cl. ..... 342/1

[58] Field of Search ..... 342/1, 2, 3

[56] References Cited

U.S. PATENT DOCUMENTS

| | | |
|---|---|---|
| Re. 25,564 | 4/1964 | Alford et al. . |
| 2,464,006 | 3/1949 | Tiley . |
| 2,527,918 | 10/1950 | Collard . |
| 2,599,944 | 6/1952 | Salisbury . |
| 2,674,644 | 4/1954 | Goodlee . |
| 2,771,602 | 11/1956 | Kohnhold . |
| 2,797,201 | 6/1957 | Veatch et al. . |
| 2,841,786 | 7/1958 | Dicke . |
| 2,898,561 | 8/1959 | Hayes . |
| 2,923,934 | 2/1960 | Halpern . |
| 2,951,247 | 8/1960 | Halpern et al. . |
| 2,992,425 | 7/1961 | Pratt . |
| 2,992,426 | 7/1961 | Borcherdt . |
| 2,996,709 | 8/1961 | Pratt . |
| 2,996,710 | 8/1961 | Pratt . |
| 3,061,495 | 10/1962 | Alford . |
| 3,152,328 | 10/1964 | McMillon . |
| 3,185,986 | 5/1965 | McCaughna et al. . |
| 3,230,184 | 1/1966 | Alford . |
| 3,247,158 | 4/1966 | Alford . |
| 3,276,895 | 10/1966 | Alford . |
| 3,295,131 | 12/1966 | Hollingsworth . |
| 3,315,259 | 4/1967 | Wesch . |
| 3,315,261 | 4/1967 | Wesch . |
| 3,316,139 | 4/1967 | Alford et al. . |
| 3,381,293 | 4/1968 | Tarpley, Jr. . |
| 3,427,619 | 2/1969 | Wesch et al. . |
| 3,443,020 | 5/1969 | Loshigian . |
| 3,540,047 | 11/1970 | Walser et al. . |
| 3,542,939 | 11/1970 | Mintz . |
| 3,622,437 | 11/1971 | Horaica . |
| 3,623,099 | 11/1971 | Suetake . |

(List continued on next page.)

FOREIGN PATENT DOCUMENTS

| | | |
|---|---|---|
| 2114422 | 10/1957 | Australia . |
| 665747 | of 0000 | United Kingdom . |
| 814310 | of 0000 | United Kingdom . |

OTHER PUBLICATIONS

Chatterjee, S. K. et al., "A Two-Dimentional Array Absorber For Microwaves", Sep. 11, 1968, pp. 103–119.

*Primary Examiner*—T. H. Tubbesing

*Attorney, Agent, or Firm*—Wolf, Greenfield & Sacks

[57] ABSTRACT

An electromagnetic energy absorbing structure provides a base structure having an electrically conductive ground plane positioned thereover. At least one dielectric and one impedance layer are positioned over the ground plane or surface on a side thereof opposite the base. An external most dielectric skin seals the structure. Additional alternating dielectric and impedance layers can be positioned over the first dielectric and impedance layers. The dielectric layer can be constructed from syntactic foam with impedance layers formed from patterns of conductive dipoles. The impedance layer, can alternatively, be formed from a resistive sheet formed into a broken pattern that may comprise a series of geometric shapes spaced from each other. The resistive sheet can be combined with a series of composite dielectric layers to form an integral composite structure.

100 Claims, 5 Drawing Sheets

U.S. PATENT DOCUMENTS 3,680,037 7/1972 Nellis et al. .
3,705,432 12/1972 Watkins, Jr. .
3,707,414 12/1972 Wismer .
3,708,871 1/1973 Mintz .
3,729,756 5/1973 Cook et al. .
3,733,606 5/1973 Johansson .
3,737,903 6/1973 Suetake et al. .
3,752,899 8/1973 Bakker .
3,754,255 8/1973 Suetake et al. .
3,789,404 1/1974 Munk .
3,835,208 9/1974 Koutitonsky .
3,849,350 11/1974 Matsko .
3,887,920 6/1975 Wright et al. ..... 342/1
3,996,654 12/1976 Johnson .
4,021,589 5/1977 Copley .
4,023,174 5/1977 Wright .
4,037,009 7/1977 Severinsen .
4,038,660 7/1977 Connolly et al. .
4,040,165 8/1977 Miessler et al. .
4,047,174 9/1977 Wohlers .
4,075,967 2/1978 Silvey .
4,084,161 4/1978 Manning et al. .
4,118,704 10/1978 Ishino et al. .
4,156,033 5/1979 Bienz .
4,173,018 10/1979 Dawson et al. .
4,229,491 10/1980 Dislich et al. .
4,301,456 11/1981 Lovick, Jr. .
4,439,768 3/1984 Ebneth et al. .
4,448,106 5/1984 Knapp .
4,474,129 10/1984 Watkins et al. .
4,493,874 1/1985 Kubo et al. .
4,520,562 6/1985 Sado et al. .
4,538,151 8/1985 Hatakeyama et al. .
4,539,433 9/1985 Ishino et al. .
4,557,965 12/1985 Karlsson .
4,560,445 12/1985 Hoover et al. .
4,581,284 4/1986 Eggert et al. .
4,605,934 8/1986 Andrews .
4,606,848 8/1986 Bond .
4,606,966 8/1986 Karlsson .
4,614,946 9/1986 Kaminetzky .
4,675,690 6/1987 Hoffman .
4,684,952 8/1987 Munson et al. .
4,716,417 12/1987 Grumet .
4,742,354 5/1988 Wen et al. .
4,748,449 5/1988 Landers, Jr. et al. .
4,791,419 12/1988 Eubanks .
4,888,590 12/1989 Chase .

ELECTROMAGNETIC ENERGY ABSORBING STRUCTURE

RELATED APPLICATION

This application is a continuation-in-part of co-pending U.S. patent application Ser. No. 07/489,924, filed on Feb. 16, 1990, now U.S. Pat. No. 5,214,432, which is itself a continuation-in-part of co-pending U.S. patent application Ser. No. 07/177,518, filed on Apr. 11, 1988, now U.S. Pat. No. 5,223,849, which is itself a continuation-in-part of U.S. patent application Ser. No. 07/010,448, filed on Feb. 23, 1987, now abandoned, which is, in turn, a continuation-in-part of U.S. patent application Ser. No. 06/934,716, filed on Nov. 25, 1986, now abandoned.

FIELD OF THE INVENTION

This invention relates to an electromagnetic energy absorbing structure and more particularly to a layered material for forming structures that absorb radar waves.

BACKGROUND OF THE INVENTION

It is often desirable in a variety of applications to provide surfaces to structures with the capability of absorbing radar and similar electromagnetic waves. In so absorbing these waves, a substantially lower magnitude of energy is reflected back to the source of the incident waves.

A variety of prior art absorbers are constructed as separate units that are subsequently positioned over a structure. Such absorbers are known as parasitic absorbers. These absorbers may comprise several layers of resistive material (so called Jauman Absorbers). A typical type of resistive absorber comprises a parasitic carbonyl iron filled rubber panel that is fitted over a given structure. Absorbers can also take the form of a plurality of layers of conductive dipoles sandwiched between dielectric layers. Such dipole absorbers are further described in co-pending U.S. patent application Ser. Nos. 07/177,518 and 07/489,924 now U.S. Pat. Nos. 5,223,849 and 5,214,432, respectively.

Several disadvantages to parasitic versions of the above-described absorbers exist. Parasitic absorbers, in general, add thickness to a structure without increasing its strength. These absorbers also are more prone to damage since they are not integrally formed with the structure. In addition, these absorbers may be more prone to damage by environmental conditions and, more prone to dislodgment from the underlying structure.

In producing layered absorbing structures it has also been necessary to utilize a material having a sufficiently low dielectric constant to obtain sufficiently wide absorption bandwidths. Often, however, such materials do not exhibit sufficient structural strength.

In view of the above-described disadvantages of the prior art, this invention has as one object to provide a material for constructing a layered electromagnetic energy absorbing structure with sufficient strength to serve as an integral part of an overall structure.

It is a further object of this invention to provide an electromagnetic energy absorbing structure that may be constructed with relative ease in a variety of shapes and configurations.

It is yet another object of this invention to provide an electromagnetic energy absorbing structure that substantially reduces or eliminates undesirable backscatter effects that may be present in certain absorbing structures.

SUMMARY OF THE INVENTION

An electromagnetic energy absorbing structure according to one embodiment of this invention provides a structural base comprising an electrically conductive member referred to herein as a ground plane or surface. The electrically conductive ground plane or surface can also be part of another structural member. The ground plane can be formed of copper or a suitable conductive material. Over the base and ground plane is positioned at least a first dielectric layer and over this dielectric layer is positioned a first impedance layer. The first impedance layer comprises a series of dipoles arranged in a semi-random or comparable pattern that can be constructed from conductive ink. An outermost dielectric skin of predetermined thickness generally covers at least the first two layers. However, additional alternating dielectric layers and conductive dipole layers can be arranged between the first pair of dielectric and conducting layers and the outermost skin. The dielectric material can comprise an epoxy resin-based, microballoon-filled, syntactic foam. Such a material has a relatively low dielectric constant and, thus, provides good broadband absorption characteristics to the structure. The layers can be joined together by adhesives or other suitable processes.

According to another embodiment of this invention, an electromagnetic energy absorbing structure can be constructed by providing layers of dielectric material over a conductive ground plane surface. One possible realization of these dielectric layers could be fiberglass reinforced epoxy composites. Between the layers of dielectric material are positioned thin layers of resistive film, generally having complex impedance characteristics (that is, non-zero reactances). These layers can be constructed by cutting or otherwise removing geometric sections from an electrically resistive film in either periodic or semi-random fashion.

These layers may also be constructed by cutting or otherwise removing sections of the film thereby leaving geometric sections of the film to form a broken pattern in either periodic or semi-random fashion. Such layers are referred to as resistive circuit analog layers. Impedance layers constructed from electrically resistive sheets of carbon black filled plastic, of which polyimide plastic is one example, in combination with fiberglass reinforced epoxy composites, provide good absorption performance.

An absorbing structure according to this embodiment can be constructed by providing a plurality of layers of bidirectional and unidirectional fiberglass fabrics, laid one atop another with an electrically conductive layer and resistive circuit analog layers positioned therebetween. The layered arrangement of fiber can then be joined by injecting an epoxy or other suitable resin into the arrangement. Upon curing, which can include application of heat, an integral structure is formed. The structural base, which can be the structural frame of a particular object, can be formed simultaneously with the absorber structure by providing a plurality of fiberglass layers on the side of the conductive layer opposite the resistive sheet layers.

BRIEF DESCRIPTION OF THE DRAWINGS

The foregoing and other objects and advantages of the invention will become more clear in view of the following detailed description of the preferred embodiments with reference to the drawings in which.

DETAILED DESCRIPTION OF THE PREFERRED EMBODIMENTS

Figure 1:
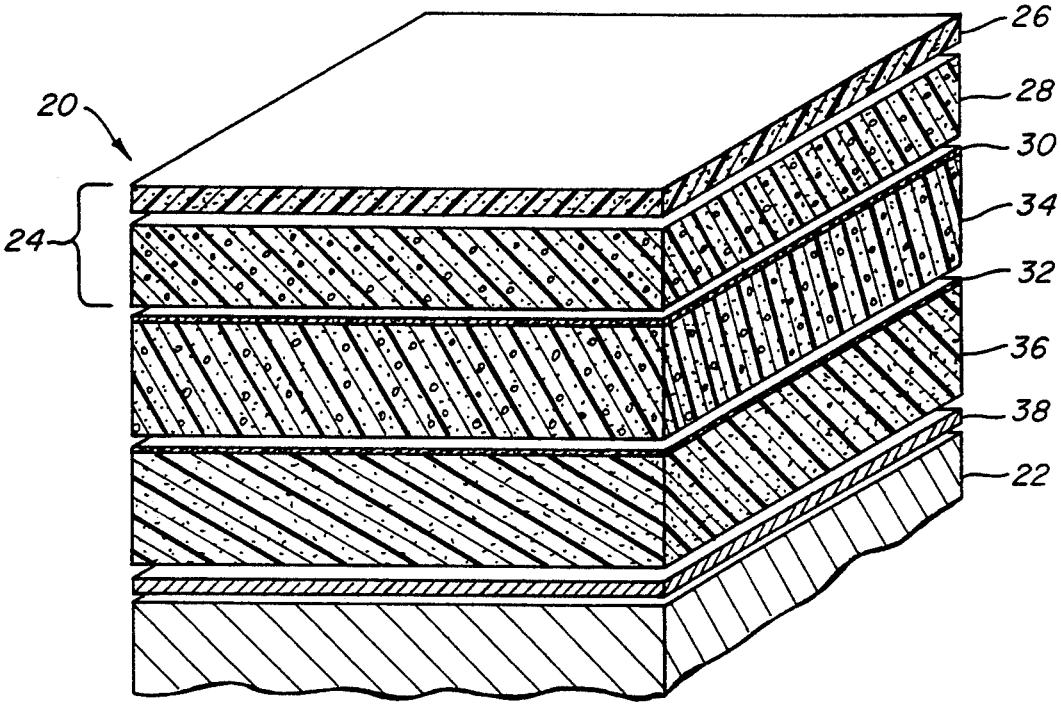
FIG. 1 is a perspective view of an electromagnetic energy absorbing structure according to one embodiment of the invention.

FIG. 1 illustrates a layered circuit analog, typically non-parasitic, electromagnetic energy absorbing structure, particularly adapted to radar frequencies, typically in the 2–18 GHz band, but also applicable to a range between approximately 500 Mhz to 94 Ghz. The structure 20 comprises a base layer 22 that can be of any desired thickness. This base layer 22 generally comprises the primary structural frame or shell of the object to be shielded by the more externally disposed absorber surface. The external most layer 24 of the structure 20 comprises a dielectric material. In this embodiment, the layer includes an outermost or external most skin 26 (closest to the incident electromagnetic wave) and inner dielectric layer 28. Internal (as taken in a direction toward the base layer 22) of the externally disposed layer 24 is positioned a pair of circuit analog conducting layers 30 and 32, respectively. The circuit analog layers 30 and 32 are divided by another dielectric layer 34. Yet another dielectric layer 36 is positioned internally of the layer 32. This layer 36 rests upon an electrically conductive shield or ground plane 38 of the absorber structure 20.

While the base 22 is separate from the conductive ground plane in this example, the base can provide the ground plane surface (e.g. the surface of a structural member) when it is constructed of a suitable conductive material such as steel, aluminum or copper. Such a surface can be utilized where the outer surface of the base structural member is regular enough to allow the overlying dielectric and circuit analog layers to be positioned over the base surface without substantial variation in the thickness of the layers. For example, a riveted base surface can possibly prove too irregular for a reliable layered absorber structure to be built thereover without an underlying separate ground plane shield. Therefore, whether or not the underlying conductive base can also serve as the ground plane largely depends upon its surface contour as well as other structural and application considerations, such as, removability and replacability of the absorber structure.

Dipole-type absorbers (Circuit Analog absorbers) are generally designed with three controlling factors in mind. In particular:

(1) The impedance of the circuit analog layer or layers (i.e., the characteristic reflection and transmission coefficients of the layer) controls the depth (degree of absorption) of the absorptive null point for a particular frequency value. In other words, it is important to accurately match the impedance of the circuit analog layer to a particular frequency for which maximum absorption is desired.

(2) The position of the circuit analog layer relative to an underlying conductive ground plane (in this example a copper mesh or plate) tends to control the frequency of a particular null. The more circuit analog layers utilized, the more nulls that are present.

(3) The dielectric constant of the various intermediate layers between circuit analog layers and, generally, on the external surface of the absorber, controls the bandwidth of a given null. In general, the lower the dielectric constant of the intermediate layers, the wider the bandwidth.

Figure 8:
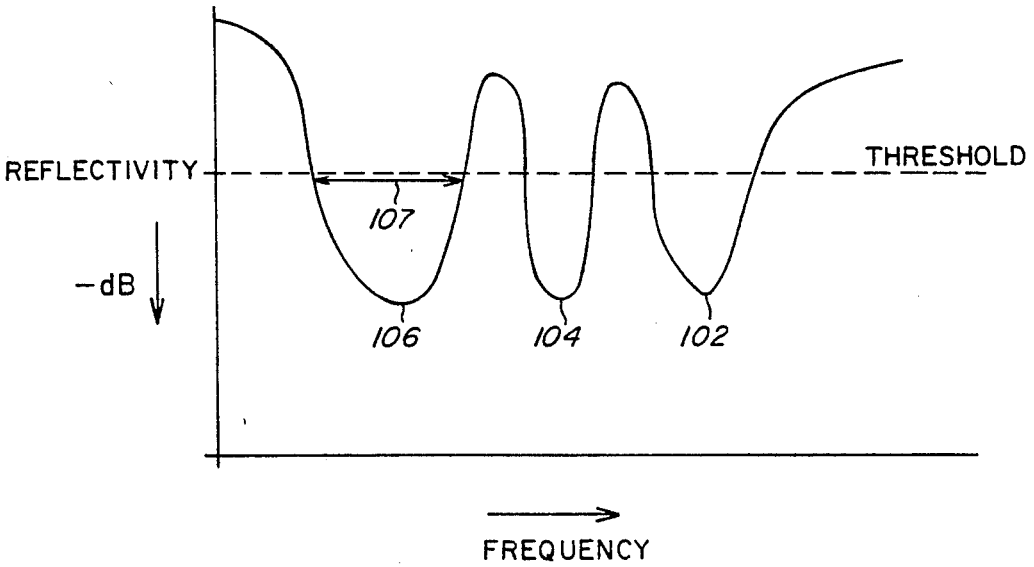
FIG. 8 is a graph illustrating generally a characteristic absorption curve including three absorptive nulls according to this invention.

For an illustration of an absorption spectrum for a typical two impedance layer absorber structure having three absorptive nulls 102, 104 and 106, see FIG. 8.

As noted above, the necessary thicknesses of the various dielectric layers are determined by the desired frequencies of maximum energy absorption, known as nulls. In one example of this embodiment, the external skin 26 comprises a fiberglass reinforced epoxy composite layer having a thickness of approximately 0.035". The external most dielectric layer 28 has a thickness of approximately 0.10" while the two more internal dielectric layers 34 and 36 have a thickness of approximately 0.15" each. The underlying ground plane 38, which comprises pure copper in this example, has a thickness of 0.015". Such a thickness should provide good reflection characteristics to incident waves.

Each of the circuit analog layers 30 and 32 are constructed so as to be easily applicable to the surface. Hence, these layers are each applied directly to the underlying dielectric layers, 34 and 36 respectively, using a conductive ink. A variety of conventional conductive inks, including, for example, nickel and copper filled inks, can be utilized according to this invention. The exact thickness of each ink layer is relatively small in comparison with the intervening dielectric layers and, therefore, does not significantly alter the spacing of the structure 20.

In order to provide a desirably low dielectric constant in the two external most dielectric layers 28 and 34, while still providing effective structural strength, the structure according to this embodiment utilizes a syntactic foam. Such a foam comprises, typically, an epoxy resin with a microballoon filler that increases the encapsulated air content of the epoxy. Hence, a relatively low dielectric constant can be achieved while providing relatively good structural strength. A dielectric syntactic by Emerson and Cuming, Inc. having a dielectric constant of approximately 1.5 can be utilized according to this invention.

It should be noted that, since the conductive ink of the circuit analog layer is laid directly upon the foam, it is desirable that the ink remain compatible with the foam. Otherwise, its electrical performance may be degraded. A nickel based conductive ink having an epoxy binder is utilized in this embodiment. Other inks and binders such as urethane, acrylic and various liquid polymers are also contemplated according to this invention, however.

It should also be noted that the layers of the structure 20 according to this embodiment are bonded to each other by means of suitable adhesive such as epoxy, urethane, silicone or other adhesives that are compatible with the ink and the foam.

The layers of the structure 20 of FIG. 1 can possibly be formed from material having a dielectric constant higher than that of syntactic foam in this example. In particular, the internal most dielectric layer 36 is constructed of a fiberglass reinforced epoxy material or a similar composite. In addition, as noted above, the external skin 26 comprises a fiberglass reinforced epoxy material. The fiberglass reinforced epoxy composite according to this embodiment has a dielectric constant of approximately 4.7. Due to the thinness of the external skin (approximately 0.03") the external skin exhibits an effective impedance characteristic. As such, this layer controls the location of the electromagnetic energy absorption null in one of the predetermined absorption frequency ranges.

Figure 2:
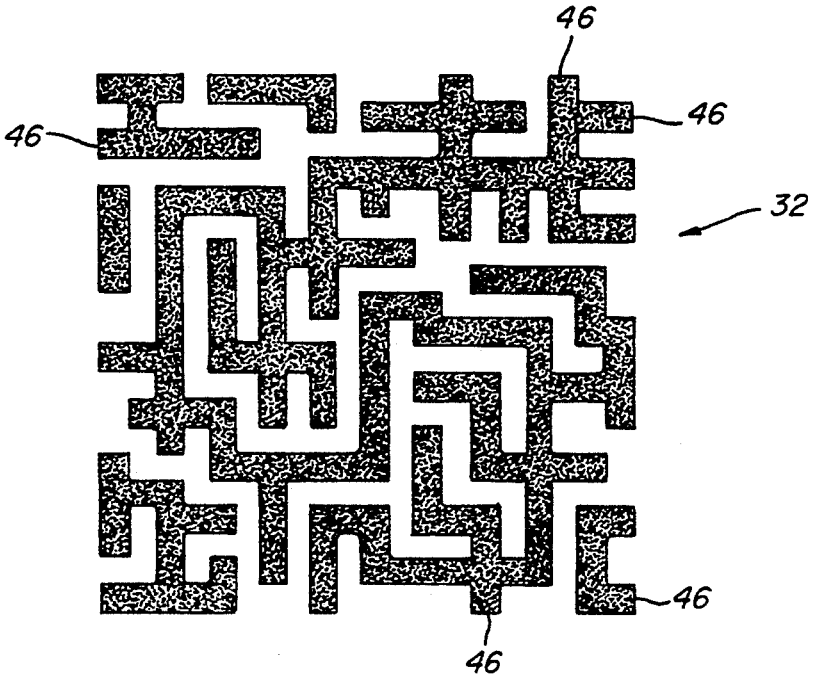
FIG. 2 is a plan view of a circuit analog substrate layer for use in the electromagnetic energy absorbing structure of FIG. 1.
Figure 3:
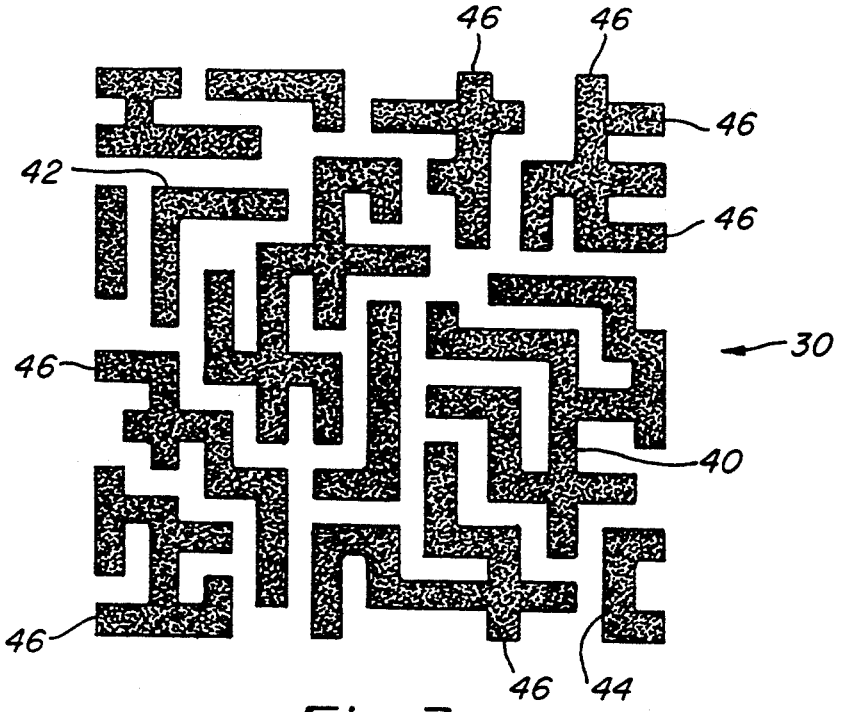
FIG. 3 is a plan view of a circuit analog superstrate layer for use in the electromagnetic energy absorbing structure of FIG. 1.

The circuit analog layers 30 and 32 carry a predetermined pattern defining a plurality of dipoles of predetermined width, length, and angular orientation. A variety of dipole patterns are contemplated according to this invention. Many possible patterns are illustrated in U.S. Pat. No. 5,214,432. However, a particular pattern having high randomness and easy repeatability is illustrated for the circuit analog layer 32 in FIG. 2 and for the circuit analog layer 30 in FIG. 3. Reference is now made to FIGS. 2 and 3 collectively and also individually where appropriate.

FIGS. 2 and 3 show, respectively, circuit analog patterns for the layer 32 closest to the ground plane 38 and the layer 30 further from the ground plane 38. These patterns are generally applied to underlying dielectric layers of the structure by screen printing a conductive ink. The darkened pathways of each pattern indicate ink locations. It should be noted that the pattern of FIG. 3 is not as dense as that of FIG. 2. In general, each pattern is formed to absorb energy in a discrete frequency range. A given impedance for the circuit analog layer dictates the absorption frequency range. Impedance of the layer pattern is, itself, governed by four parameters including (1) the pattern dipole element line width, (2) length of the dipole elements, (3) orientation of the dipole elements upon the surface, and (4) the conductivity of the ink from which the dipole elements are constructed. In general, the denser the pattern, all other factors being equal, the lower the impedance and the lower the absorption frequency. By experimentally varying each of these parameters, a different absorption frequency range for each layer can be obtained. Since the range of each layer is contemplated as being different, the pattern element length and width, as well as the density of elements for each layer is varied. Generally, conductivity of the ink remains the same for the pattern of each layer.

Orientation of the elements is generally similar for each pattern. The orientation depicted reveals a substantially exponential distribution of element lengths. For any given pattern, such as the pattern of FIG. 3, there will exist two long dipoles 40, four medium length dipoles 42, and sixteen short dipoles 44. These dipoles have lengths that are, typically, at least a tenth of a wavelength for the frequency of a desired absorptive null.

The patterns of FIGS. 2 and 3 comprise a self-contained repeatable pattern that may be easily screened over the entire surface of the structure. Thus, the pattern is easily adaptable to machine controlled screen printing processes. When properly applied, each width-defining end (such as ends 46 in FIG. 3) mates with a width-defining end of an adjacent identical pattern. Thus the dipoles of each square pattern join with dipoles of adjacent squares. An unbroken chain of dipoles can, therefore, be disposed across the entire surface of the structure.

Figure 4:
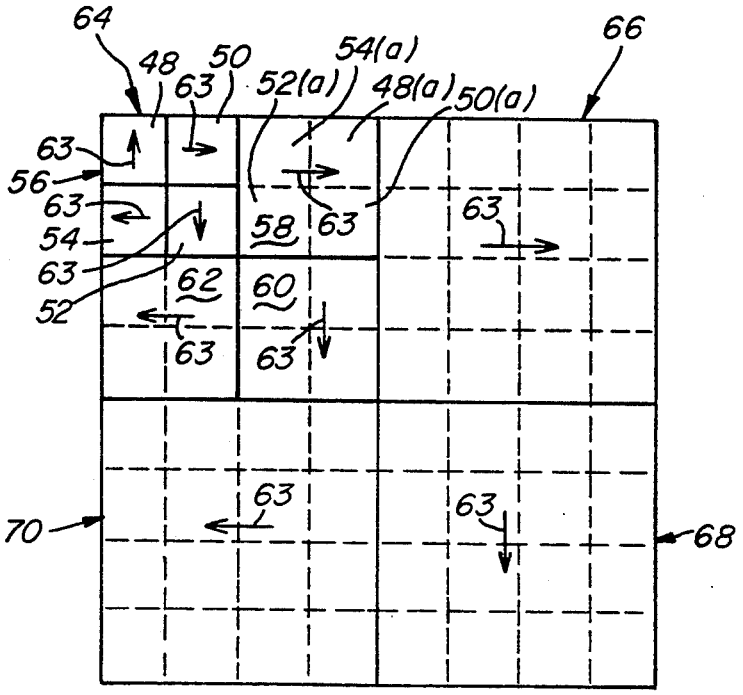
FIG. 4 is a schematic plan view of a semi-random rotation pattern for use with the circuit analog patterns of FIGS. 2 and 3.

It is further desirable to construct a dipole pattern that is as random as possible upon the surface. Thus, the pattern of FIGS. 2 and 3 is designed so that it can be rotated through four consecutive 90° turns and still allow mating between width-defining dipole ends (46). Hence, a pattern as shown schematically in FIG. 4 can be applied to a surface. As stated, the pattern is made up of a plurality of adjacent squares as shown in FIGS. 2 and 3. Each of these individual squares can be, for example, 1"×1". The overall design of each individual square in the pattern is the same. However, FIG. 4 illustrates how a semi-random array of similar squares can be arranged by alternating the orientation of the pattern. As noted above, the pattern of FIGS. 2 and 3 is designed to mesh with identical adjacent patterns in such a manner that any side of the pattern can mesh to any other side of the same pattern to form an unbroken chain of dipoles.

FIG. 4 illustrates a plurality of boxes, each representative of a given dipole pattern. Each of the boxes is oriented according to its respective arrow 63. These arrows are representative of an arbitrary orientation for the pattern. For example, pattern box 48 includes an arrow 63 pointing straight upwardly. Such an arrow indicates a first orientation. Box 50, adjacent to box 48, shows an arrow 63 rotated 90° clockwise relative to the arrow 63 of box 48. Thus, the pattern in box 50 has rotated 90° relative to the box 48 pattern. Similarly, the arrow 63 of box 52 indicates that its pattern is rotated clockwise 180° relative to the pattern of box 48. Finally, box 54 includes a pattern rotated 270° relative to box 48.

It is desirable to dispose the dipole element pattern in a random or semi-random array across a given surface.

Semi-randomness of the pattern is achieved according to this embodiment by rotating progressively larger groupings of pattern boxes (squares) by 90° intervals around a preceding grouping of boxes. In other words, box 58 comprises a set of four boxes. If one assumes that the set of 4 boxes 48, 50, 52 and 54, as a group, would comprise a first orientation (depicted by an upward arrow that is not shown), then box 58 would be rotated clockwise as a group by 90°. The individual pattern boxes 48(*a*), 50(*a*), 52(*a*) and 54(*a*) correspond to boxes 48, 50, 52 and 54 but have been rotated, as a group, by 90°. Box 60, comprising the same individual pattern of boxes as found in box 56 and 58 has been rotated by 180°. Similarly, box 6 has been rotated by 270°.

The overall grouping 64 of four boxes 56, 58, 60 and 62 that each, themselves, include the pattern of boxes analogous to 48, 50, 52 and 54, are again repeated in adjacent sets of boxes 66, 68 and 70 that are each rotated as shown by the arrow 63. Hence, as larger and larger groups of boxes are built into the pattern, they continue to rotate around the central most box 48. The substituent groups of boxes within each of the larger outwardly disposed boxes simply repeats rotational patterns of the more inwardly disposed sets of boxes.

Thus, the pattern of FIG. 4, makes possible the construction of a "semi-random" array of circuit analog dipoles from a single repeatable circuit analog pattern such as that shown in FIGS. 2 and 3. This semi-random pattern is, as stated above, desirable since it makes possible relatively even absorption over an entire structure surface according to this invention.

Even when low dielectric materials are utilized, circuit analog absorbers still retain some disadvantages for certain applications. One disadvantage is the existence of electromagnetic backscatter which occurs at certain predetermined frequencies and viewing angles. Backscatter arises because electrically conductive dipoles reradiate incident electromagnetic energy in a roughly omni-directional pattern. The reradiated energy of an array of regularly spaced dipoles adds constructively at a particular angle relative to the array for any particular frequency. This is differentiated from a specular, forward-scattered energy reflection, and instead, can scatter significant amounts of energy back to the source of the incident wave.

The above-described embodiment provides a highly effective electromagnetic energy absorbing structure. However, if no back scatter is tolerable with such a structure, it could be desirable to provide an electromagnetic energy absorbing structure based upon multiple layers of shaped resistive material. Resistive materials do not exhibit measurable backscatter since electromagnetic energy exciting the structure is attenuated rather than reradiated. An individual thin unbroken sheet of resistive material provides a relatively frequency-independent impedance curve across a broad range of frequencies. As such, a remaining disadvantage of resistive sheet layers is that they are not adapted to follow a particular impedance versus frequency curve as circuit analogs are.

Therefore, a resistive sheet layer does not exhibit the desired broadband null point absorption characteristic. This lack of deep broadband null points limits the uses of resistive sheet layers in certain electromagnetic energy absorption applications.

In order to develop a characteristic impedance curve in a resistive sheet layer according to this invention one must form the resistive sheet into a circuit analog-type pattern. As used herein, a circuit analog pattern on a resistive sheet can be termed generally as "broken" since the sheet has a surface that is not continuous. The formation of a design comprising two layers of resistive sheets modified into circuit analog patterns according to this invention is shown in FIG. 5.

Figure 5:
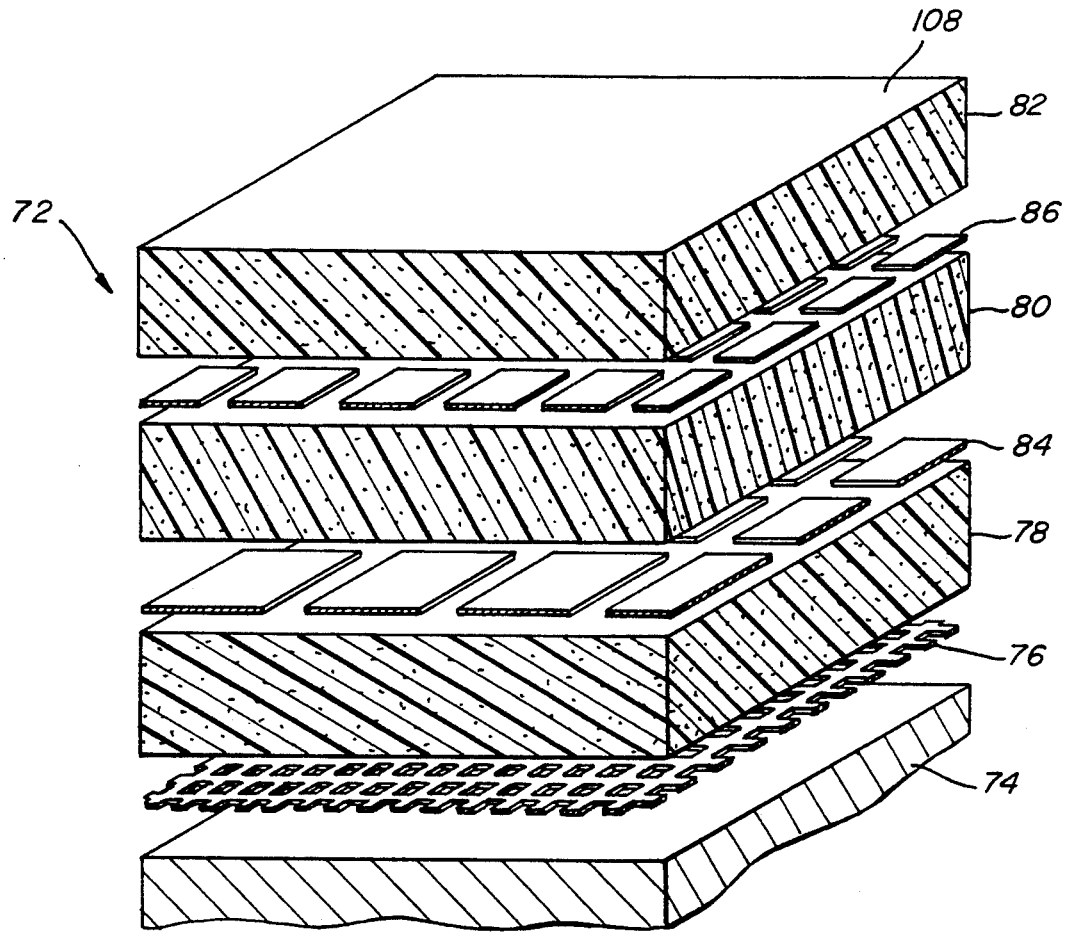
FIG. 5 is an alternative embodiment of an electromagnetic energy absorbing structure according to this invention.

FIG. 5 illustrates a multilayer resistive circuit analog electromagnetic energy absorbing structure 72 according to an alternative embodiment of this invention. The layered electromagnetic energy absorbing structure is formed over a base layer 74 that, like the layer 22 in FIG. 1, may comprise a primary structural frame or skin for the object to be shielded. The structure 72 includes a base 74 and an electrically conductive ground plane 76 comprising, in this embodiment, an expanded mesh screen of essentially pure copper.

It should be noted that an expanded mesh screen is constructed by perforating a sheet of copper with thin slots in one direction and then expanding the sheet in the direction perpendicular to the slots to obtain a desired diamond-shaped mesh size. An advantage of forming an electrically conductive ground plane sheet in this manner is that the sheet is substantially flat and fully interconnected, allowing for better reflection of incident waves. A woven screen can also be used. In general, a perforated screen of some type is desirable since it allows a liquid matrix, such as epoxy resin, to flow through the ground plane layer in this embodiment during the formation of the structure which is described further below.

External of the ground plane 76 are positioned alternating layers of fiberglass reinforced epoxy dielectric 78, 80 and 82 and intervening resistive circuit analog layers 84 and 86.

Figure 7:
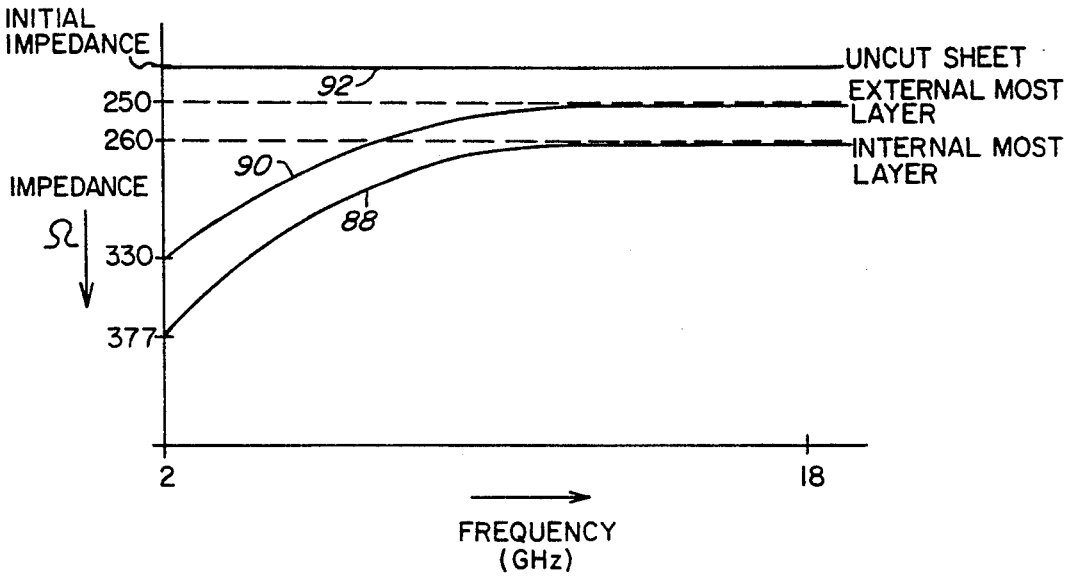
FIG. 7 is a graph of impedance versus frequency for each of an uncut resistive sheet and each of a pair of formed resistive sheets for each of two layers according to this invention.

Each of the circuit analog resistive layers 84 and 86 is formed in a separated square pattern according to this embodiment. By separating the sheet into discrete divided squares, a circuit analog-type impedance curve can be obtained. Particular impedance curves for each of the resistive layers 84 and 86 are shown in FIG. 7. A given impedance curve according to this embodiment depends upon the size of the squares, their relative spacing, and the ohmic value of the resistive material. The precise impedance characteristics for any given sheet construction must be determined experimentally. Thus, the impedance curves representing the closer resistive layer performance 88 and the further resistive performance 90 are variable based upon the particular material and configuration utilized. The curves of FIG. 7 are typical for carbon black filled polyimide film material such as Du Pont XC TM film. Note that the initial resistive value of the uncut film is frequency-independent across the frequency range of FIG. 7 as illustrated by the curve for the uncut sheet 92.

In the embodiment of FIG. 5, impedance characteristics such as those shown in FIG. 7 are obtained by sizing squares in a range between 0.5" and 1.5". A spacing of between 0.05" and 0.10" between squares is also used. The exact spacing and size for each layer is typically determined experimentally to obtain a desired impedance characteristic. In general, the resistive layer 86 further from the ground plane 76 will carry smaller squares than the closer resistive layer 84. The spacing between squares in each layer can be similar, however. While other geometric shapes can be utilized for the resistive circuit analog layer sheets, a square is preferred for manufacturing ease. The reflection pattern of a square closely approximates a circle and, thus, 360° rotation will yield substantially equal reflection. Note also that the square could, itself, comprise a number of smaller broken subsections such as triangles. In general, however, the shape should carry a symmetrical configuration so that impedance is constant throughout a 360° rotation of the surface. Thus, use of a hexagon, on equilateral triangle or another regular polygonal shape is possible according to this invention. Similarly, a number of other symmetrical and non-symmetrical geometric arrangements for resistive layers are contemplated according to this invention.

Thus, in a preferred embodiment, impedance layers comprise a series of square patches of particular dimensions separated by gaps of particular widths. Such patterns generate frequency dependent impedance characteristics.

The proper combination of alternating thin layers of specific impedance characteristics, in conjunction with dielectric layers of specific dielectric constants and thicknesses, backed by a reflective ground plane layer, can set up an effective input impedance close to that of free space at the front face of the structure which allows for low reflected energy levels (deep nulls) in frequency bands around desired center frequencies.

Figure 6:
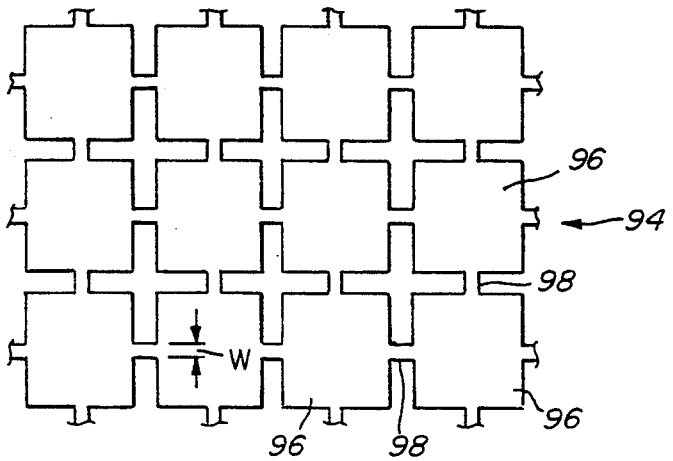
FIG. 6 is a plan view of a resistive circuit analog layer for use in the electromagnetic energy absorbing structure of FIG. 5.

The specific manufacturing of a radar absorbing structure according to this embodiment will be described further below. For ease of manufacture of the structure, it would be desirable to form the resistive layers 84 and 86 as single units. FIG. 6 shows one method of forming a cut square sheet 94 in which the squares 96 are still joined by narrow runners 98. Hence, the sheet may be laid upon the surface of the structure 72 as a discrete singular layer. The runners 98 guarantee that a predetermined spacing will be maintained between each of the squares 96 in the sheet 94. The structural strength added by the runners is particularly useful when the structure is formed using high pressure and high temperature forming techniques.

The runners 98 are maintained relatively narrow in this embodiment. A width W of 0.080" should suffice to provide structural strength to a sheet formed, for example, from polyimide. In practical terms, the runners 98 do not affect impedance characteristics of the layer and, in fact, may improve the overall performance of the layer by insuring an accurate spacing and orientation of squares 96 relative to one another.

Referring again to FIG. 5, the thickness of each of the dielectric layers 78, 80 and 82 must be controlled closely in order to obtain absorptive nulls at desired frequencies. As noted, a two impedance layer absorber structure will generate three characteristic absorptive nulls. These three nulls can be represented generally by the graph in FIG. 8 and occur at a highest frequency 102, a middle range frequency 104, and a lowest frequency 106. As noted above, if the frequency of the incident electromagnetic energy falls within the bandwidth 107 of a given null, the incident waves are absorbed sufficiently to prevent their measurable reflection. Absorption below a "threshold" amount indicated by the dotted line prevents such measurable reflection.

The thickness distance between the external surface 108 and the more external resistive layer 86 controls the frequency of the highest absorptive null 102. This distance is characterized by the electrical thickness of the external dielectric layer 82. Similarly, the distance between the more external resistive layer 86 and the more internal resistive layer 84 controls the frequency of the middle absorptive null 104. This distance is characterized by the electrical thickness of the middle dielectric layer 80. Finally, the lowest absorptive null 106 is controlled by the distance between the resistive layer 84 and the ground plane screen 76. This distance is characterized by the electrical thickness of the internal most dielectric layer 78. The thickness of the film of each resistive layer 84 and 86 is itself relatively insignificant and, thus, does not substantially influence the frequency location of each absorptive null. Particularly, a film such as Du Pont XC TM polyimide film is typically on the order of 0.002" to 0.004" thickness.

As discussed above, each of the dielectric layers 78, 80 and 82 of FIG. 5 are constructed from fiberglass reinforced epoxy. Fiberglass reinforced epoxy composite has an advantage over syntactic foam in that it is stronger and, thus, particularly suited for structures subjected to severe environmental conditions. Fiberglass reinforced epoxy is also more easily formed into shapes since it allows for injection of resin in a cavity mold to bind an otherwise easily formable reinforcing fabric, such as fiberglass, polyimide or polyethylene, so as to allow formation of a variety of complex shapes. Syntactic foam can sometimes prove more limited in its formation into complex shapes.

The resin can, in fact, be a variety of hardenable liquid matricies including epoxy and polyester according to this embodiment. The layers of the structure can be formed from a combination of materials including, for example, a layer of woven polyethylene and a layer of fiberglass, in which each material is chosen for its particular dielectric and/or other characteristics.

A typical disadvantage of fiberglass reinforced epoxy is that its dielectric constant is substantially higher than that of syntactic foam. Most standard fiberglass reinforced epoxy composites have a dielectric constant on the order of 4.7. As noted above, a higher dielectric constant narrows the bandwidth of each absorptive null. This means that a smaller frequency range will lie within the absorption threshold. Thus, it is desirable to lower the dielectric constant of the fiberglass reinforced epoxy composite as much as possible.

The dielectric constant of the fiberglass reinforced epoxy can be adjusted by changing the ratio of fiberglass to epoxy resin. It has been found that the dielectric constant of a material reinforced matrix composite structure, such as fiberglass reinforced epoxy composite, follows, generally, a volume fraction mixing rule such that:

$$D_{composite} = D_{material}^{V_{material}} \times D_{matrix}^{V_{matrix}}$$

In which D is the dielectric constant for the given constituent and V is the volume fraction for the given constituent.

Hence according to the above equation, by way of one example, by utilizing a 52% by volume fiberglass to 48% by volume epoxy resin ratio, using S-glass fiberglass with a dielectric constant of 5.1 and an epoxy resin with a dielectric constant of 3.2, it is possible to produce a composite having a dielectric constant of approximately 4.1. By constructing a composite having this dielectric constant, the resistive circuit analog absorber structure of this embodiment can obtain electromagnetic energy absorption performance similar to that of the syntactic foam conductive circuit analog embodiment described herein above.

The thickness of the fiberglass reinforced epoxy layers tend to increase from external most to internal most. In one embodiment, the external layer 82 has a thickness of 0.130". The middle layer 80 has a thickness of 0.140" and the internal most layer 78 has a thickness of 0.150". In this embodiment, as in the syntactic foam embodiment, the ground plane 76 can have a thickness of approximately 0.015".

An absorbing structure 72 according to FIG. 5 is constructed by providing plies of fiberglass fabric to build up the dielectric layers. The glass fabric layers are laid one over the other until an appropriate thickness is obtained. In general, glass fabric layers having a thickness of 0.010" are used. Thus, to form a 0.150" thick layer of dielectric, fifteen layers of glass fabric are laid one atop the other. Each dielectric composite layer can be formed by combining a number of bidirectional layers (usually in the form of woven glass fabric) with various unidirectional layers (usually comprising yarns of glass all running in a single direction and joined by intermittent crossing woven threads of glass). The use of unidirectional glass fabric enables the structure to carry increased flexural and tensile strength along a certain direction. This can be desirable when a structure must have enhanced rigidity along one direction. The packing ratio of unidirectional and bidirectional glass fabric also determines the glass volume fraction for the composite which, as stated above, affect the overall dielectric constant of the composite.

Layers of bidirectional and unidirectional glass fabric are plied up to a desired composite layer thickness. Between each built-up composite layer of fabric is positioned a sheet of resistive circuit analog material. The sheet, as noted above, is preformed into joined squares or similar geometric patterns.

Figure 9:
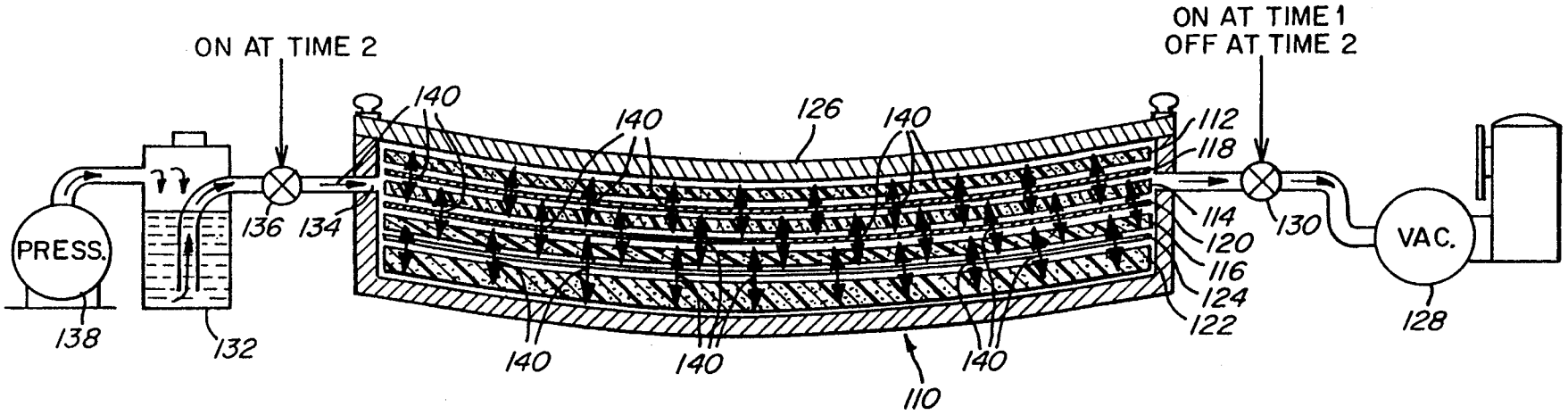
FIG. 9 is a schematic diagram illustrating a process for forming electromagnetic energy absorbing structures according to this invention.

Once the entire layered structure is assembled in a cavity mold, the structure is subjected to pressurized injection of epoxy resin. This process is illustrated in FIG. 9.

A cavity mold 110 having an internal shape that conforms to a desired structural shape is provided with alternating layers of fiberglass and resistive circuit analog patterned sheet. In this embodiment, the fiberglass dielectric layers 112, 114 and 116 sandwich a pair of resistive sheet layers 118 and 120. In this example the base 122 of the structure is also constructed of fiberglass and, thus, a ground plane screen 124 is provided between the base 122 and the internal most dielectric layer 116.

As noted above, the spacing between the dielectic layers 112, 114 and 116, the ground plane and the resistive layers should be closely controlled. Thus, the fiberglass (in this example) material layers should be spread out across the mold evenly so as to avoid bulges and buckles. The mold in this example has a curve. The layers bend to conform to this curve. The exact thickness and contour of the base 122 can vary as long as the layers external of the ground plane 124 have a thickness that remains constant relative to the ground plane surface. In other words, at any point along the absorber surface, the tops and bottoms of the layers should be equal in depth from the ground plane.

In this example there is space shown between layers for illustration purposes. However, in practice the layers should be maintained in close proximity to each other to insure accurate maintenance of the desired layer thickness.

The mold 110 is sealed by a cover 126 so that it can be made air tight. Upon sealing, after initial layup of the layers, the mold 110 is generally evacuated (at a first TIME 1) by a vacuum source 128. The source should include a valve 130 that allows the mold 110 to be isolated from the vacuum source 128 to allow maintenance of a continuous vacuum within the mold after TIME 1.

Once the mold 110 is evacuated, epoxy resin or a similar hardenable liquid matrix from a resin source 132 is introduced at TIME 2 to the mold 110 via an inlet 134 that includes a valve 136. A number of inlets to the mold 110 can be employed depending upon the size and complexity of the structure. The matrix flows into the evacuated mold 110 under pressure from a pressure source 138.

The matrix has sufficient flow characteristics to pass through the porous material (fiberglass cloth, for example) and ground plane screen as illustrated by the flow arrows 140. Thus, all parts of the structure become permeated by the matrix. The matrix is then allowed to harden to generate the final desired rigid structure.

The resin matrix epoxy utilized according to this particular embodiment requires thermal curing to obtain a final hardness. Curing occurs, for example, at approximately 160°-350° F. Polyimide is particularly suitable in providing a resistive circuit analog sheet since it can withstand temperatures of up to approximately 500° F. Thus, the curing temperature will not affect or degrade its performance. Polyimide is compatible for bonding to epoxy resin and, thus, becomes integrally and firmly secured to the overall structure. The initial sheet resistivity is, similarly, not degraded by epoxy resin.

The foregoing has been a detailed description of preferred embodiments. Various modifications and equivalents are contemplated herein. The foregoing description, therefore, is meant to be taken only by way of example and not to otherwise limit the scope of this invention. For example, various other materials can be utilized in the formation of circuit analog and resistive layers according to this invention. Similarly, various adhesives and dielectric materials can be substituted for those disclosed herein. Finally, while each of the preferred embodiments depict two impedance layers, it is contemplated that fewer or more layers can be included depending upon the number of absorptive nulls desired. Therefore, the scope of this invention should only be deemed to be limited by the appended claims.

What is claimed is:

1. An electromagnetic energy absorbing structure comprising:

a base including an electrically conductive ground surface disposed over a surface of the base;

at least a first dielectric layer disposed over the ground surface;

a first impedance layer, the impedance layer comprising a resistive material having a first predetermined broken pattern, and having an impedance in a range of approximately 200–400 ohms disposed over the first dielectric layer on a side thereof opposite the ground layer, and a skin dielectric layer disposed external-most from the base.

2. The structure of claim 1 further comprising a second dielectric layer disposed over the first impedance layer on a side thereof opposite the first dielectric layer.

3. The structure of claim 2 further comprising a second impedance layer, the layer comprising a resistive material and having an impedance in a range of approximately 200–400 ohms and having a second predetermined broken pattern, disposed over the second dielectric layer on a side thereof opposite the first impedance layer.

4. The structure of claim 3 further comprising a third dielectric layer disposed over the second impedance layer on a side thereof opposite the second dielectric layer.

5. The structure of claim 4 wherein each of the first and the second impedance layers and the first, the second and the third dielectric layers are all parallel to each other.

6. The structure of claim 4 wherein at least one of the first and the second impedance layers comprises a resistive layer having one of a corresponding first and second broken pattern formed in a resistive material sheet.

7. The structure of claim 6 wherein at least one of the first and the second broken pattern comprises a plurality of repeating adjacent geometric shapes each having a predetermined spacing therebetween.

8. The structure of claim 7 wherein each of the geometric shapes comprises a substantially identical square and the predetermined spacing between each adjacent square is substantially equal.

9. The structure of claim 8 wherein each of the first and the second impedance layers comprises a plurality of substantially identical squares of a resistive sheet each square spaced a predetermined distance from adjacent squares, the squares of the first impedance layer each being larger than the squares of the second impedance layer.

10. The structure of claim 1 wherein the first impedance layer comprises a resistive layer formed from a resistive sheet having a plurality of adjacent discrete geometrical shapes thereon spaced a predetermined distance from each other.

11. The structure of claim 10 wherein each of the geometrical shapes comprises a substantially identical square and the predetermined distance of spacing for each of adjacent squares is substantially equal.

12. The structure of claim 1 wherein the first impedance layer comprises a polymer having a lossy material contained therein.

13. The structure of claim 12 wherein the polymer comprises polyimide.

14. The structure of claim 13 wherein the lossy material comprises carbon black.

15. An electromagnetic energy absorbing structure comprising:

a base including an electrically conductive ground surface disposed over a surface of the base;

a first dielectric layer disposed on the ground surface;

a first impedance layer, being one of a resistive and a conductive layer having a first predetermined broken pattern, disposed over the first dielectric layer on a side thereof opposite the ground layer;

a second dielectric layer disposed over the first impedance layer;

a second impedance layer, being one of a resistive and a conductive layer having a second predetermined broken pattern, disposed over the second dielectric layer on a side thereof opposite the first impedance layer;

a third dielectric layer disposed over the second impedance layer on a side thereof opposite the second dielectric layer, wherein each of the first and the second impedance layers and the first, wherein the second and the third dielectric layers are all parallel to each other and wherein at least one of the second and third dielectric layers comprise a syntactic foam; and a skin dielectric layer disposed external-most from the base.

16. The structure of claim 15 wherein at least one of the first and the second impedance layers comprises a conductive layer having a corresponding first and second broken pattern of dipoles formed from conductive ink.

17. The structure of claim 16 wherein the conductive ink includes a polyester binder and is positioned directly upon at least one of the second and the third dielectric layers.

18. An electromagnetic energy absorbing structure comprising:

a base including an electrically conductive ground surface disposed over a surface of the base;

a first dielectric layer disposed over the ground surface;

a first impedance layer, being one of a resistive and a conductive layer having a first predetermined broken pattern, disposed over the first dielectric layer on a side thereof opposite the ground layer;

a second dielectric layer disposed over the first impedance layer on a side thereof opposite the first dielectric layer;

a second impedance layer, being one of a resistive and a conductive layer having a second predetermined broken pattern, disposed over the second dielectric layer on a side thereof opposite the first impedance layer;

a third dielectric layer disposed over the second impedance layer on a side thereof opposite the second dielectric layer; and a skin dielectric layer disposed external-most from the base wherein the third dielectric layer includes the external-most skin layer comprising a fiberglass reinforced epoxy composite layer and the third dielectric layer also includes an internal most syntactic foam layer proximate the second impedance layer.

19. An electromagnetic energy absorbing structure comprising:

a base including an electrically conductive ground surface disposed over a surface of the base;

a first dielectric layer disposed over the ground surface;

a first impedance layer, having a first predetermined broken pattern, disposed over the first dielectric layer on a side thereof opposite the ground layer, wherein the first impedance layer comprises a conductive layer and the first predetermined broken pattern comprises a series of varying length dipoles arranged in each of a first and a second perpendicular direction; and a skin dielectric layer disposed external-most from the base.

20. The structure of claim 19 wherein the first predetermined broken pattern includes a plurality of adjacent squares of the series of varying length dipoles, the dipoles of each square being joined so as to form a continuous pattern.

21. The structure of claim 20 wherein the series of varying length dipoles in each square is rotated at least 90° relative to the respective series of varying length dipoles in each respective of adjacent squares thereto, the series of varying length dipoles being arranged so that predetermined of the dipoles in each of adjacent rotated squares forms a continuous semi-random pattern.

22. An electromagnetic energy absorbing structure comprising:

a base including an electrically conductive ground surface disposed over a surface of the base;

a first dielectric layer disposed over the ground surface;

a first impedance layer, being one of a resistive and a conductive layer having a first predetermined broken pattern, disposed over the first dielectric layer on a side thereof opposite the ground layer;

a second dielectric layer disposed over the first impedance layer on a side thereof opposite the first dielectric layer;

a second impedance layer, being one of a resistive and a conductive layer having a second predetermined broken pattern, disposed over the second dielectric layer on a side thereof opposite the first impedance layer, wherein at least one of the first and the second impedance layers comprises a resistive layer having one of a corresponding first and second broken pattern formed in a resistive material sheet, wherein the resistive material sheet comprises a polymer sheet having a lossy material disposed therein;

a third dielectric layer disposed over the second impedance layer on a side thereof opposite the second dielectric layer; and a skin dielectric layer disposed external-most from the base.

23. The structure of claim 22 wherein the resistive material sheet comprises a polyimide sheet.

24. The structure of claim 22 wherein each of the first, the second and the third dielectric layers comprises a fiberglass reinforced epoxy composite material.

25. The structure of claim 24 wherein the fiberglass reinforced epoxy composite material includes a plurality of layers of bidirectional and unidirectional glass cloth, each of the plurality of layers having a predetermined directional orientation.

26. An electromagnetic energy absorbing structure comprising:

a base including an electrically conductive ground surface disposed over a surface of the base;

a first dielectric layer disposed over the ground surface;

a first impedance layer, being one of a resistive and a conductive layer having a first predetermined broken pattern, disposed over the first dielectric layer on a side thereof opposite the ground layer;

a second dielectric layer disposed over the first impedance layer on a side thereof opposite the first dielectric layer;

a second impedance layer, being one of a resistive and a conductive layer having a second predetermined broken pattern, disposed over the second dielectric layer on a side thereof opposite the first impedance layer, wherein at least one of the first and the second impedance layers comprises a resistive layer having one of a corresponding first and second broken pattern formed in a resistive material sheet, and wherein at least one of the first and the second broken pattern comprises a plurality of repeating adjacent substantially identical squares each having a predetermined space therebetween, wherein the predetermined space between each adjacent square is substantially equal and wherein each of the squares is joined to an adjacent square in the resistive sheet by a runner extending from adjacent edges of adjacent squares, the runners being substantially narrower than the edges;

a third dielectric layer disposed over the second impedance layer on a side thereof opposite the second dielectric layer; and a skin dielectric layer disposed external-most from the base.

27. An electromagnetic energy absorbing structure comprising:

a base including an electrically conductive ground surface disposed over a surface of the base;

a first dielectric layer disposed over the ground surface, wherein the base comprises a structural member of an object and at least the first dielectric layer is formed of the same material as the base;

a first impedance layer, being one of a resistive and a conductive layer having a first predetermined broken pattern, disposed over the first dielectric layer on a side thereof opposite the ground layer; and a skin dielectric layer disposed external-most from the base.

28. The structure of claim 27 wherein the base and the first dielectric layer each comprise a material reinforced matrix bonded composite material and wherein the matrix of each of the base and the dielectric layer is applied substantially simultaneously in a single step.

29. The structure of claim 28 wherein the electrically conductive ground surface comprises an expanded mesh screen of substantially pure copper disposed over the base.

30. A method of forming electromagnetic energy absorbing structure comprising the steps of:

providing a base layer including an electrically conductive ground surface on the base layer;

positioning at least a first dielectric layer over the ground surface, the first dielectric layer having a predetermined thickness relative to the ground surface;

positioning at least a first impedance layer, the first impedance layer comprising a broken pattern resistive material having a lossy material therein, the first impedance layer being positioned over the dielectric layer on a side thereof opposite the ground layer, the first impedance layer having a predetermined thickness relative to the first dielectric layer;

positioning a dielectric skin layer at an external-most location relative to the base, the skin layer having a predetermined thickness; and permanently securing the base, the ground layer, at least the first dielectric layer, at least the first impedance layer and the skin layer together so as to form an integral structural member having a predetermined shape.

31. The method of claim 30 wherein the step of positioning the first impedance layer includes applying a first resistive sheet having a plurality of substantially identical geometrical shapes over the first dielectric layer.

32. The method of claim 31 wherein the step of applying the first resistive sheet includes forming the substantially identical geometrical shapes into squares each having substantially equal spacing therebetween.

33. The method of claim 31 further comprising providing a second dielectric layer over the first impedance layer and further providing a second impedance layer of the second dielectric layer on a side thereof opposite the first impedance layer.

34. The method of claim 33 wherein the step of providing the second impedance layer includes applying a second resistive sheet having a plurality of substantially identical geometrical shapes over the second dielectric layer.

35. The method of claim 34 further comprising positioning a third dielectric layer over the second impedance layer on a side thereof opposite the second dielectric layer.

36. The method of claim 30 wherein the positioning of at least the first impedance layer includes providing an impedance layer that comprises a polymer.

37. The method of claim 30 wherein the positioning of at least the first impedance layer includes providing a resistive layer that comprises polyimide.

38. The method of claim 30 wherein the positioning of at least the first impedance layer includes providing a resistive material having an impedance in a range of approximately 100–500 ohms.

39. The method of claim 38 wherein the positioning of at least the first impedance layer further includes providing a resistive material having carbon black.

40. The method of claim 30 wherein the step of permanently securing includes injecting a hardenable liquid matrix to secure each of the base layer, the first dielectric layer, the first impedance layer and the dielectric skin layer together, forming a structural member therefrom.

41. The method of claim 40 wherein the step of permanently securing includes providing a cavity mold for receiving the structure and injecting a hardenable liquid matrix under pressure into the cavity mold and subsequently curing the matrix to harden the matrix.

42. A method of forming an electromagnetic energy absorbing structure comprising the steps of:

providing a base layer including an electrically conductive ground surface on the base layer;

positioning at least a first dielectric layer disposed over the ground surface, the first dielectric layer having a predetermined thickness relative to the ground surface;

positioning at least a first impedance layer, the first impedance layer being one of a broken pattern resistive layer and a conductive layer, over the dielectric layer on a side thereof opposite the ground layer, the first impedance layer having a predetermined thickness relative to the first dielectric layer, wherein the step of positioning at least the first impedance layer includes applying a conductive layer over the first dielectric layer, the step of applying including screen printing conductive ink in a predetermined pattern;

positioning a dielectric skin layer at an external-most location relative to the base, the skin layer having a predetermined thickness; and permanently securing the base at least the first dielectric layer, at least the first impedance layer and the skin layer together so as to form an integral structural member having a predetermined shape.

43. A method of forming an electromagnetic energy absorbing structure comprising the steps of:

providing a base layer including an electrically conductive ground surface on the base layer;

positioning at least a first dielectric layer over the ground surface, the first dielectric layer having a predetermined thickness relative to the ground surface;

positioning at least a first impedance layer, the first impedance layer being one of a broken pattern resistive layer and a conductive layer, over the dielectric layer on a side thereof opposite the ground layer, the first impedance layer having a predetermined thickness relative to the first dielectric layer, wherein the step of positioning at least the first impedance layer includes forming an impedance layer pattern having a plurality of varying length dipoles arranged in each of a first and a second perpendicular direction;

positioning a dielectric skin layer at an external-most location relative to the base, the skin layer having a predetermined thickness; and permanently securing the base, at least the first dielectric layer, at least the first impedance layer and the skin layer together so as to form an integral structural member having a predetermined shape.

44. The method of claim 43 further comprising the step of positioning a second dielectric layer over the first impedance layer on a side thereof opposite the first dielectric layer, the step of forming including placing the predetermined pattern on at least one of the first and the second dielectric layers at facing surfaces thereof.

45. The method of claim 44 wherein the step of positioning a second dielectric layer includes providing syntactic foam proximate the first impedance layer.

46. The method of claim 45 further comprising positioning a second impedance layer having a predetermined thickness, the second impedance layer being one of a conductive and resistive layer, over the second dielectric layer.

47. The method of claim 46 further comprising positioning a third dielectric layer having a predetermined thickness relative to the second impedance layer over the second impedance layer on a side thereof opposite the second dielectric layer.

48. The method of claim 47 wherein the step of positioning the third dielectric layer includes providing syntactic foam proximate the second impedance layer.

49. The method of claim 48 wherein the step of permanently securing includes at least one of applying adhesive between dielectric layers and injecting a hardenable liquid matrix between the base, the first dielectric layer and the skin layer.

50. The method of claim 46 wherein the step of positioning the second impedance layer includes applying conductive ink in a predetermined pattern to at least one of the second and the third dielectric layers along facing surfaces thereof.

51. A method of forming an electromagnetic energy absorbing structure comprising the steps of:

providing a base layer including an electrically conductive ground surface on the base layer;

positioning at least a first dielectric layer over the ground surface, the first dielectric layer having a predetermined thickness relative to the ground surface;

positioning at least a first impedance layer, the first impedance layer being a broken pattern resistive layer, over the dielectric layer on a side thereof opposite the ground layer, the first impedance layer having a predetermined thickness relative to the first dielectric layer, and the step of positioning the first impedance layer further including applying a first resistive sheet having a plurality of substantially identical squares each having substantially equal spacing therebetween over the first dielectric layer, wherein the step of applying the first resistive sheet includes providing a sheet of polyimide material that includes a lossy material;

positioning a dielectric skin layer at an external-most location relative to the base, the skin layer having a predetermined thickness; and permanently securing the base, at least the first dielectric layer, at least the first impedance layer and the skin layer together so as to form an integral structural member having a predetermined shape.

52. The method of claim 51 wherein the step of providing a sheet of polyimide material includes providing a sheet of Du Pont XC TM material.

53. A method of forming an electromagnetic energy absorbing structure comprising the steps of:

providing a base layer including an electrically conductive ground surface on the base layer;

positioning a first dielectric layer over the ground surface, the first dielectric layer having a predetermined thickness relative to the ground surface;

positioning a first impedance layer over the dielectric layer on a side thereof opposite the ground layer, the first impedance layer having a predetermined thickness relative to the first dielectric layer, the step of positioning the first impedance layer further including applying a first resistive sheet having a plurality of substantially identical geometrical shapes over the first dielectric layer;

positioning a second dielectric layer over the first impedance layer over the second dielectric layer on a side thereof opposite the first impedance layer, the step of positioning the second impedance layer including applying a second resistive sheet having a plurality of substantially identical geometric shapes over the second dielectric layer, wherein the identical geometrical shapes of the first impedance layer are larger than the identical geometrical shapes of the second impedance layer;

positioning a dielectric skin layer at an external-most location relative to the base, the skin layer having a predetermined thickness; and permanently securing each of the base, the first dielectric layer, the first impedance layer the second dielectric layer, the second impedance layer and the skin layer together so as to form an integral structural member having a predetermined shape.

54. A method of forming an electromagnetic energy absorbing structure comprising the steps of:

providing a base layer including an electrically conductive ground surface on the base layer;

positioning a first dielectric layer over the ground surface, the first dielectric layer having a predetermined thickness relative to the ground surface;

positioning a first impedance layer over the dielectric layer on a side thereof opposite the ground layer, the first impedance layer having a predetermined thickness relative to the first dielectric layer, the step of positioning the first impedance layer including applying a first resistive sheet having a plurality of substantially identical geometrical shapes over the first dielectric layer;

positioning a second dielectric layer over the first impedance layer and further positioning a second impedance layer over the second dielectric layer on a side thereof opposite the first impedance layer, wherein the step of positioning the second impedance layer includes applying a second resistive sheet having a plurality of substantially identical geometrical shapes over the second dielectric layer;

positioning a third dielectric layer over the second impedance layer on a side thereof opposite the second dielectric layer;

positioning a dielectric skin layer at an external-most location relative to the base, the skin layer having a predetermined thickness;

wherein the step of providing the base layer and the steps of positioning each of the first, the second and the third dielectric layers include applying a predetermined number of layers of unidirectional and bidirectional material in predetermined orientations; and permanently securing each of the base, the first dielectric layer, the first impedance layer, the second dielectric layer, the third dielectric layer and the skin layer together so as to form an integral structural member having a predetermined shape.

55. The method of claim 54 wherein the step of permanently securing includes injecting a hardenable liquid matrix for adhering each of the layers of unidirectional and bidirectional material to one another.

56. A method of forming an electromagnetic energy absorbing structure comprising the steps of:

providing a base layer including an electrically conductive ground surface on the base layer;

positioning at least a first dielectric layer over the ground surface, the first dielectric layer having a predetermined thickness relative to the ground surface;

positioning at least a first impedance layer, the first impedance layer being one of a broken pattern resistive layer and a conductive layer, over the dielectric layer on a side thereof opposite the ground layer, the first impedance layer having a predetermined thickness relative to the first dielectric layer;

positioning a dielectric skin layer at an external-most location relative to the base, the skin layer having a predetermined thickness; and permanently securing the base, the ground layer, at least the first dielectric layer, at least the first impedance layer and the skin layer together so as to form an integral structural member having a predetermined shape, wherein the step of permanently securing includes providing a cavity mold for receiving the structure and injecting a hardenable liquid matrix under pressure into the cavity mold and subsequently curing the matrix to harden the matrix.

57. The method of claim 56 wherein the at least one of the dielectric layers comprise fiberglass and wherein the matrix comprises an epoxy resin and wherein the step of curing includes exposing the epoxy resin to heat for a predetermined period of time.

58. An electromagnetic energy absorbing structure comprising;

a base structure comprising a structural member of an object and including an electrically conductive surface;

a first dielectric layer positioned over the electrically conductive surface;

a first conductive layer comprising a first dipole pattern positioned over the first dielectric layer;

a second dielectric layer comprising syntactic foam positioned over the first conductive layer;

a second conductive layer comprising a second dipole pattern positioned over the second dielectric layer; and an external-most dielectric skin layer, at least one of the first and the second dipole pattern comprising a plurality of varying length linear segments of conductive dipole material, at least some of the segments being interconnected with other of the segments.

59. The structure of claim 58 wherein predetermined groupings of dipole segments form a block having a predetermined pattern, at least one of the first conductive layer and the second conductive layer having a plurality of blocks comprising the predetermined pattern thereover.

60. The structure of claim 59 wherein at least some of the blocks are located adjacent each other, the pattern of at least some of the blocks being rotated relative to other adjacent of the blocks.

61. The structure of claim 60 wherein at least some of the blocks comprise squares and wherein the pattern of blocks are rotated in increments of 90° relative to a pattern and adjacent of the blocks.

62. An electromagnetic energy absorbing structure comprising:

a base structure comprising a structural member of an object and including an electrically conductive surface;

a first dielectric layer positioned over the electrically conductive surface;

a first conductive layer comprising a first dipole pattern positioned over the first dielectric layer;

a second dielectric layer comprising a syntactic foam positioned over the first conductive layer;

a second conductive layer comprising a second dipole pattern positioned over the second dielectric layer, wherein at least one of the first and the second conductive layers comprise conductive ink applied to one of the first and second dielectric layers; and an external-most dielectric skin layer.

63. The structure of claim 62 further comprising a third dielectric layer positioned over the second conductive layer.

64. The structure of claim 63 wherein the third dielectric layer includes syntactic foam proximate the second conductive layer.

65. The structure of claim 64 wherein the third dielectric layer includes the external most dielectric skin layer remote from the second conductive layer.

66. The structure of claim 62 wherein at least one of the first and second dipole pattern comprises a repeating square pattern having a plurality of dipoles oriented along each of two perpendicular directions, the square pattern being arranged so that each plurality of dipoles is adjacent another of the plurality of dipoles.

67. The structure of claim 66 wherein the plurality of dipoles of each square pattern is rotated relative to at least one adjacent square pattern so that a semi-random pattern of dipoles is formed.

68. An electromagnetic energy absorbing structure comprising:

a base structure comprising a structural member of an object and including an electrically conductive surface;

a first dielectric layer positioned over the electrically conductive surface;

a first resistive layer comprising a first resistive sheet of material having a broken pattern formed thereon and having an impedance in a range of approximately 250–377 ohms, positioned over the first dielectric layer;

a second dielectric layer positioned over the first conductive layer;

a second resistive layer comprising a second resistive sheet having a broken pattern and having an impedance in a range of approximately 250–377 ohms, positioned over the second dielectric layer; and an external-most dielectric skin layer.

69. The structure of claim 68 wherein at least one of the first and second resistive sheets includes a pattern formed therein comprising a plurality of separated geometrical shapes.

70. The structure of claim 69 wherein the geometrical shapes each comprise an identical square and each identical square is spaced at an equal distance from adjacent identical squares.

71. The structure of claim 70 wherein each identical square is sized in a range between 0.5 inches and 1.5 inches.

72. The structure of claim 71 wherein each of the first and second resistive sheets includes a pattern formed therein comprising a plurality of identical squares and wherein the identical squares of the first resistive sheet are larger than the identical squares of the second resistive sheet.

73. The structure of claim 70 wherein each identical square is spaced from adjacent identical squares a distance in a range of 0.05 inches to 0.10 inches.

74. The structure of claim 68 wherein at least one of the first resistive layer and the second resistive layer comprises a polymer sheet having a lossy material contained therein.

75. An electromagnetic energy absorbing structure comprising:

a base structure comprising a structural member of an object and including an electrically conductive surface;

a first dielectric layer positioned over the electrically conductive surface;

a first resistive layer comprising a first broken pattern resistive sheet positioned over the first dielectric layer;

a second dielectric layer positioned over the first conductive layer;

a second resistive layer comprising a second broken pattern resistive sheet positioned over the second dielectric layer;

wherein at least one of the first and the second resistive sheets includes a pattern formed therein comprising a plurality of separated identical squares, wherein each identical square is spaced at an equal distance from adjacent identical squares, and wherein a side of each of the squares includes a narrow runner extending to a side of an adjacent of the squares so that a spacing therebetween is maintained; and an external-most dielectric skin layer.

76. An electromagnetic energy absorbing structure comprising:

a base structure comprising a structural member of an object and including an electrically conductive surface;

a first dielectric layer positioned over the electrically conductive surface;

a first resistive layer comprising a first broken pattern resistive sheet positioned over the first dielectric layer;

a second dielectric layer positioned over the first conductive layer;

a second resistive layer comprising a second broken pattern resistive sheet positioned over the second dielectric layer, wherein at least one of the first and the second resistive sheets comprises a carbon black-filled polyimide material; and an external-most dielectric skin layer.

77. The structure of claim 76 wherein each of the first and the second dielectric layers comprises a material reinforced hardened liquid matrix composite.

78. The structure of claim 77 wherein the material of at least one of the first dielectric layer and the second dielectric layer includes glass fiber layers and wherein the matrix comprises an epoxy resin.

79. The structure of claim 77 formed by a process including the steps of:

providing layers of material for each of the first dielectric layer and the second dielectric layer to a cavity mold;

providing a base structure having the electrically conductive surface thereon and providing the first resistive sheet and the second resistive sheet between predetermined of the layers of material in the cavity mold; and injecting the liquid matrix under pressure so that it passes between each of the layers of material to form an integral structure that joins the first and the second resistive sheets and the base together.

80. The structure of claim 79 further comprising the step of heat curing the matrix subsequent to injecting.

81. The structure of claim 79 wherein at least one of the material layers comprises fiberglass and the matrix comprises an epoxy resin.

82. The structure of claim 81 wherein the fiberglass includes S-glass therein.

83. The structure of claim 79 wherein at least one of the first and the second resistive sheets comprises Du Pont XC TM.

84. The structure of claim 79 wherein the base comprises a metallic structural member.

85. The structure of claim 79 wherein the base comprises a plurality of layers of material having the electrically conductive surface positioned thereover.

86. The structure of claim 85 wherein the electrically conductive surface comprises an expanded mesh copper screen.

87. The structure of claim 79 wherein at least one of the material layers comprises a combination of at least two of polyimide, polyethelene and fiberglass.

88. A method of forming a radar absorbing structure comprising the steps of:

providing a forming surface having a predetermined shape;

providing a structural material in a layer over the forming surface;

providing an electrically conductive surface over the structural material;

providing at least one layer of fibrous material over the electrically conductive surface;

providing at least one layer of sheet material formed into a broken pattern, the sheet material being resistive, over the fibrous material;

providing an external layer of fibrous material over the resistive material;

applying a liquid hardenable matrix to each of the structural material, the fibrous material, the resistive material and the external layer of fibrous material, the matrix passing therebetween; and curing the matrix so that a structural member having the predetermined shape is formed thereby.

89. The method of claim 88 wherein the step of providing the structural material includes providing a material that comprises fiberglass, the step of providing at least one layer of the fibrous material includes providing a material that comprises fiberglass and the step of providing the external layer of fibrous material includes providing a material that comprises fiberglass.

90. The method of claim 89 wherein the step of applying the liquid hardenable matrix includes providing a matrix that comprises an expoxy resin.

91. The method of claim 90 wherein the step of providing at least one layer of the sheet material includes providing a polymer sheet having a lossy material contained therein.

92. The method of claim 88 further comprising, applying a second layer of fibrous material over the resistive layer and applying a second resistive layer over the second layer of fibrous material, the external layer of fibrous material being located over the second resistive layer.

93. An electromagnetic energy absorbing structure comprising:

a base structure comprising a structural member of an object and including an electrically conductive surface thereon;

a first dielectric layer positioned over the electrically conductive surface;

a first resistive sheet positioned over the first dielectric layer, the first resistive sheet including a broken pattern comprising a plurality of first geometric shapes having a first predetermined size, the first resistive sheet being spaced from the conductive surface at a first predetermined distance;

a second dielectric layer positioned over the first conductive layer;

a second resistive sheet positioned over the second dielectric layer, the second resistive sheet including a broken pattern comprising a plurality of second geometric shapes having a second predetermined size, the second resistive sheet being spaced from the conductive surface at a second predetermined distance; and wherein each of the first predetermined size, the first predetermined spacing, the second predetermined size and the second predetermined spacing are sized and arranged so that electromagnetic waves in at least two discrete frequency bands are absorbed, a spectral location of the bands being relative to a value for each of the first predetermined size, the second predetermined size, the first predetermined spacing and the second predetermined spacing.

94. An electromagnetic energy absorbing structure as set forth in claim 93 wherein each of the first resistive sheet and the second resistive sheet each comprise a polymer having a lossy material therein.

95. An electromagnetic energy absorbing structure as set forth in claim 93 further comprising a dielectric skin layer having a predetermined thickness positioned over the second resistive sheet.

96. An electromagnetic energy absorbing structure as set forth in claim 95 wherein each of the first dielectric layer, the second dielectric layer and the skin layer comprise a fibrous material interconnected by a hardened liquid matrix.

97. An electromagnetic energy absorbing structure as set forth in claim 96 wherein the base structure comprises a fibrous material interconnected to each of the first dielectric layer, the second dielectric layer and the skin layer by the hardened liquid matrix.

98. An electromagnetic energy absorbing structure as set forth in claim 97 wherein the fibrous material comprises fiberglass.

99. An electromagnetic energy absorbing structure as set forth in claim 97 wherein the hardened liquid matrix comprises epoxy resin.

100. An electromagnetic energy absorbing structure as set forth in claim 93 wherein at least one of the first geometric shapes and the second geometric shapes comprise squares, the squares being separated by predetermined distances.

* * * * *